US010914072B2

(12) United States Patent
Paulger

(10) Patent No.: US 10,914,072 B2
(45) Date of Patent: Feb. 9, 2021

(54) APPARATUS FOR ARRANGING STEEL REINFORCEMENT PRIOR TO A CONCRETE POUR

(71) Applicant: JALT Technologies Pty Ltd, Northgate (AU)

(72) Inventor: Jeremy Alan Paulger, Northgate (AU)

(73) Assignee: JALT Technologies Pty Ltd, Northgate (AU)

( * ) Notice: Subject to any disclaimer, the term of this patent is extended or adjusted under 35 U.S.C. 154(b) by 0 days.

(21) Appl. No.: 16/492,569

(22) PCT Filed: Mar. 26, 2018

(86) PCT No.: PCT/AU2018/050282
§ 371 (c)(1),
(2) Date: Sep. 9, 2019

(87) PCT Pub. No.: WO2018/176088
PCT Pub. Date: Oct. 4, 2018

(65) Prior Publication Data

US 2020/0040581 A1 Feb. 6, 2020

(30) Foreign Application Priority Data

Mar. 29, 2017 (AU) ..... 2017901138

(51) Int. Cl.
*E04C 5/16* (2006.01)
*E04C 5/20* (2006.01)

(52) U.S. Cl.
CPC ..... *E04C 5/168* (2013.01); *E04C 5/201* (2013.01)

(58) Field of Classification Search
CPC ..... E04C 5/168; E04C 5/201
See application file for complete search history.

(56) References Cited

U.S. PATENT DOCUMENTS 4,598,523 A * 7/1986 Tolliver ..... E04C 5/20 52/685
5,937,604 A 8/1999 Bowron
(Continued)

FOREIGN PATENT DOCUMENTS

EP 0606107 A1 * 7/1994 ..... E04C 5/168
EP 2963205 A1 * 1/2016 ..... E04G 13/04
(Continued)

OTHER PUBLICATIONS

International Search Report and Written Opinion dated May 18, 2018 for International Application No. PCT/AU2018/050282 in 10 pages.
(Continued)

*Primary Examiner* — Babajide A Demuren
(74) *Attorney, Agent, or Firm* — Womble Bond Dickinson (US) LLP

(57) ABSTRACT

A rebar support comprising: an elongate body have a first plurality of rebar cradles disposed along its length for holding rebars in a first direction; a plurality of chairs located along a back of the elongate body, each of the chairs including at least one cradle for holding steel reinforcement members in a second direction at right angles to the first direction; and first and second complementary engagement formations located at opposed ends of the elongate body for facilitating end-to-end fastening of two or more rebar supports.

20 Claims, 10 Drawing Sheets

(56) References Cited

U.S. PATENT DOCUMENTS

| | | | | |
|---|---|---|---|---|
| 6,837,017 | B2 | 1/2005 | Hardy et al. | |
| 2004/0031228 | A1* | 2/2004 | Hardy, Jr. | E04C 5/167 52/687 |
| 2004/0099785 | A1* | 5/2004 | Juedes | E04C 5/163 249/207 |
| 2009/0100784 | A1* | 4/2009 | Garza | E04C 5/163 52/686 |
| 2010/0307098 | A1 | 12/2010 | Yee | |

FOREIGN PATENT DOCUMENTS

| | | | |
|---|---|---|---|
| EP | 2975189 | | 1/2016 |
| FR | 2208037 | A * | 7/1974 |

OTHER PUBLICATIONS

Written Opinion of the International Searching Authority dated Dec. 21, 2018 for International Application No. PCT/AU2018/050282 in 8 pages.

International Preliminary Report on Patentability dated Mar. 26, 2019 for International Application No. PCT/AU2018/050282 in 19 pages.

* cited by examiner

APPARATUS FOR ARRANGING STEEL REINFORCEMENT PRIOR TO A CONCRETE POUR

RELATED APPPLICATIONS

The present application claims priority from Australian provisional patent application No. 2017901138 filed 29 Mar. 2017, the contents of which is hereby incorporated in its entirety.

TECHNICAL FIELD

The present invention is directed to an apparatus to assist in the rapid installation of steel reinforcement prior to pouring concrete for making a reinforced concrete structure.

BACKGROUND

Any references to methods, apparatus or documents of the prior art are not to be taken as constituting any evidence or admission that they formed, or form part of the common general knowledge.

High-rise buildings are typically constructed using poured reinforced concrete. Poured reinforced concrete construction involves the use of very large quantities of reinforcing steel bars. The steel bars are often simply referred to as "rebar" or "rio". In order to construct a reinforced concrete wall much work is involved in arranging the rebar. Typically the rebar includes longitudinal steel reinforcement members, which for the building of a wall are vertical, across which a plurality of transverse rebars, which are horizontal, are tied. The job of fixing the transverse rebar to the longitudinal steel reinforcement members is typically the occupation of steel fixers. Given the very large number of steel reinforcement members that are used in constructing a high-rise building many worker-hours are required with associated cost. Apart from the use of rebar in vertical walls, rebar it is also used in other concrete structures such as decks, columns, and core structures, for example elevator shafts and stairwells.

Tying a vertically spaced series of horizontal transverse rebar to vertical steel reinforcement members requires that the steel fixers must hold the transverse rebar and make a fastening at every cross-over with a vertical reinforcement member using a special steel tie. It will be realized that human error may creep in to such a process so that the rebar may not be laid out as accurately as might be desired and furthermore the ties that are achieved may not always be as strong as might be desired.

In order to strive to make the ties at the correct locations, steel fixers have traditionally made evenly, centered, horizontally spaced marks on adjacent form work to indicate height placements for the horizontal steel reinforcement bars. The steel fixer marks out by hand each wall's center on the adjacent vertical plywood formwork using a brightly colored crayon in order that the marks are visible for the steel fixer to see before the steel is tied transversely.

The work of the steel fixer can be very arduous since it is physically demanding and somewhat painful to maintain a consistent vertical gap between each horizontal bar while tying above the steel fixer's head.

As an example, to manually steel fix a 9 m×3 m longitudinal wall with front and back matt would usually require having four steel fixers present as follows:

a. One up the top feeding bars b. One on a first end of the wall c. One on a second end of the wall d. One in the middle holding the bar from sagging and also tying off The tying off of the transverse rebar must be repeated every 200 mm all the way up to the top of the wall.

It would be highly advantageous if an apparatus were provided that reduced the time taken to arrange steel reinforcement prior to a concrete pour and which helped to make the arrangement of the steel reinforcement accurate.

SUMMARY OF THE INVENTION

According to a first aspect of the present invention there is provided a rebar support comprising an elongate body having a first plurality of rebar cradles disposed along its length for holding transverse rebars.

Preferably each rebar cradle includes at least one retaining member for biasing against the rebar to thereby hold the rebar firmly within the cradle.

In a preferred embodiment of the invention each cradle includes first and second opposed retaining members which cooperate for retaining a rebar therebetween.

In a preferred embodiment of the invention each retaining member extends from a first side of the cradle and is formed with a return back toward the cradle.

The outer side of the return may be formed with gripping formations such as ribs or other protrusions.

Preferably each retaining member is formed with a lip portion for assisting in guiding the rebar into the cradle.

In the preferred embodiment of the invention opposed ends of the elongate body are formed with complementary fasteners so that a plurality of the rebar supports may be fastened end-to-end.

Preferably a first end of the elongate body is formed with a complementary fastener in the form of a plug. Preferably a second end of the elongate body is formed with a complementary fastener in the form of a socket. For example the plug may include first and second clasp members which are received within the socket wherein the socket is formed with first and second recesses or openings for engagement with the first and second clasp members.

It is preferred that socket has openings through it in order that air cannot be trapped therein subsequent to concrete being poured about the rebar support.

It is preferred that one or more spacing members extend laterally from the elongate body for spacing the rebar support from adjacent formwork during use.

In a preferred embodiment of the invention the rebar support further includes one or more second cradles for retaining a longitudinal steel reinforcement members at right angles to the first plurality of cradles.

Preferably the one or more second cradles form part of at least one chair that extends from the elongate body.

In a preferred embodiment of the invention said chair is detachable from the elongate body. Preferably the chair includes a cross-member having first and second sides wherein an engagement formation for attachment to the elongate body is accessible from the first side and wherein one or more spacers in the form of offset tabs extend from the second side. The engagement formation may for example comprise a chair clip. Preferably the one or more second cradles extend from the first side. In a preferred embodiment of the invention the chair clip includes opposed resilient catch members that may be urged toward each other upon insertion of steel reinforcement members into the second cradles.

In a preferred embodiment of the invention the elongate body is formed with a rail or "backbone" for imparting rigidity along the length of the elongate body. In a preferred embodiment of the invention opposed cutouts are formed into opposite sides of the rail for receiving the chair clip. Preferably the resilient catch members of the chair clip are urged toward opposed sides of the rail upon insertion of the steel reinforcement members into the second cradles.

Preferably the rebar support is formed of non-ferrous material that is unreactive with concrete, For example, polyphenylene sulphide (PPS) though other plastics which are suitably strong and durable may also be used.

In a preferred embodiment of the invention the rebar support is approximately 500 mm in length so that two of the rebar supports fastened end-to-end will have a combined length of about 1 m.

It is preferred that the cradles are dimensioned to receive up to 35 mm diameter rebar and that the opposed retaining members dimensioned to hold between 16 mm and 35 mm diameter rebar between them. It will of course be understood that these dimensions are given only for a better understanding of the preferred embodiment of the invention and that other dimensions may be used as necessary to suit an intended application.

According to a further embodiment of the present invention there is provided a method for making a steel reinforced concrete structure including the steps of:

- installing at least two, spaced apart, rebar supports each having an elongate body and a series of cradles for locating transverse rebars, said supports being of a material that is unreactive to concrete, in a location for receiving a concrete pour;
- disposing a first set of longitudinal rebars along each of the spaced apart rebar support members and a second set of transverse rebars between the spaced apart rebar members and to thereby produce cross overs of rebars of the first set and of the second set;
- making the concrete pour to submerge said rebar support members and said rebars; and
- allowing the concrete to set about the rebar support members and the rebars.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
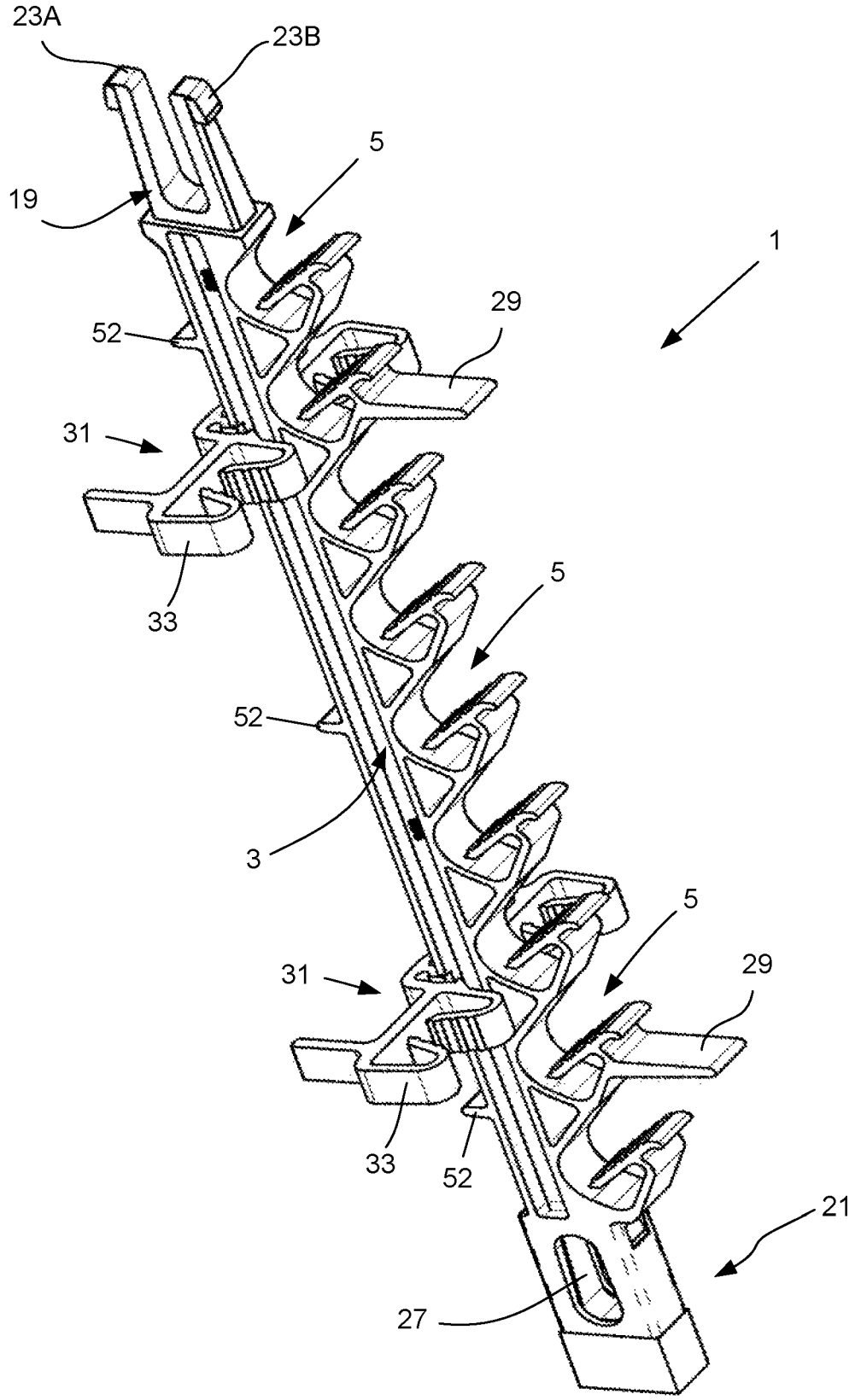
FIG. 1 is a view of a rebar support according to a preferred embodiment of the present invention.

Referring now to FIG. 1 a rebar support 1 according to a preferred embodiment of the present invention is depicted. The rebar support 1 comprises an elongate body 3, having a first plurality of rebar cradles 5 disposed along its length. Preferably the rebar support 1 is formed of non-ferrous material that is not reactive with concrete, For example, polyphenylene sulphide (PPS), though other materials which are suitably strong concrete-stable, and durable may also be used.

The rebar support 1 is approximately 500 mm in length so that two of the rebar supports fastened end-to-end will have a combined length of about 1 m.

The rebar cradles 5 that are disposed along the length of the elongate body 3 are spaced apart about 50 mm. It is preferred that each of the cradles 5 are dimensioned to receive 16 mm rebar. It will of course be understood that these dimensions are given only for a better understanding of the preferred embodiment of the invention and that other dimensions may be used as necessary to suit an intended application.

Figure 2:
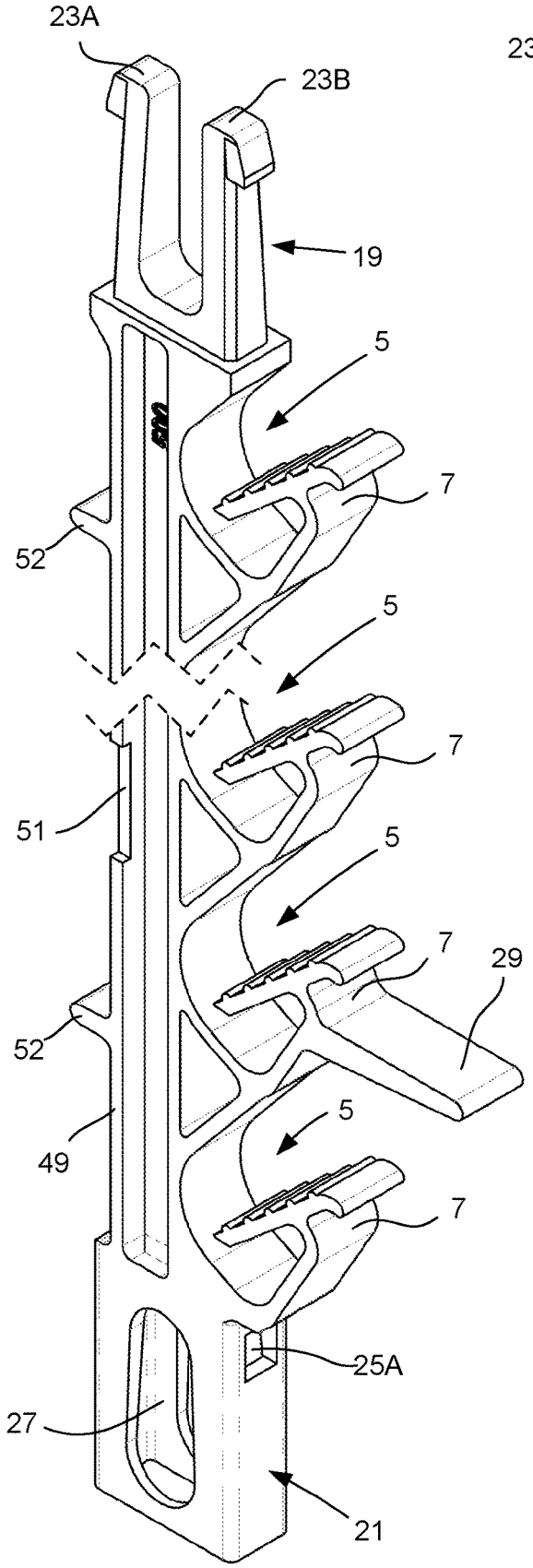
FIG. 2 is an isometric view of the rebar support with a break along its length so that the top and bottom ends of the rebar support can be seen in detail.
Figure 3:
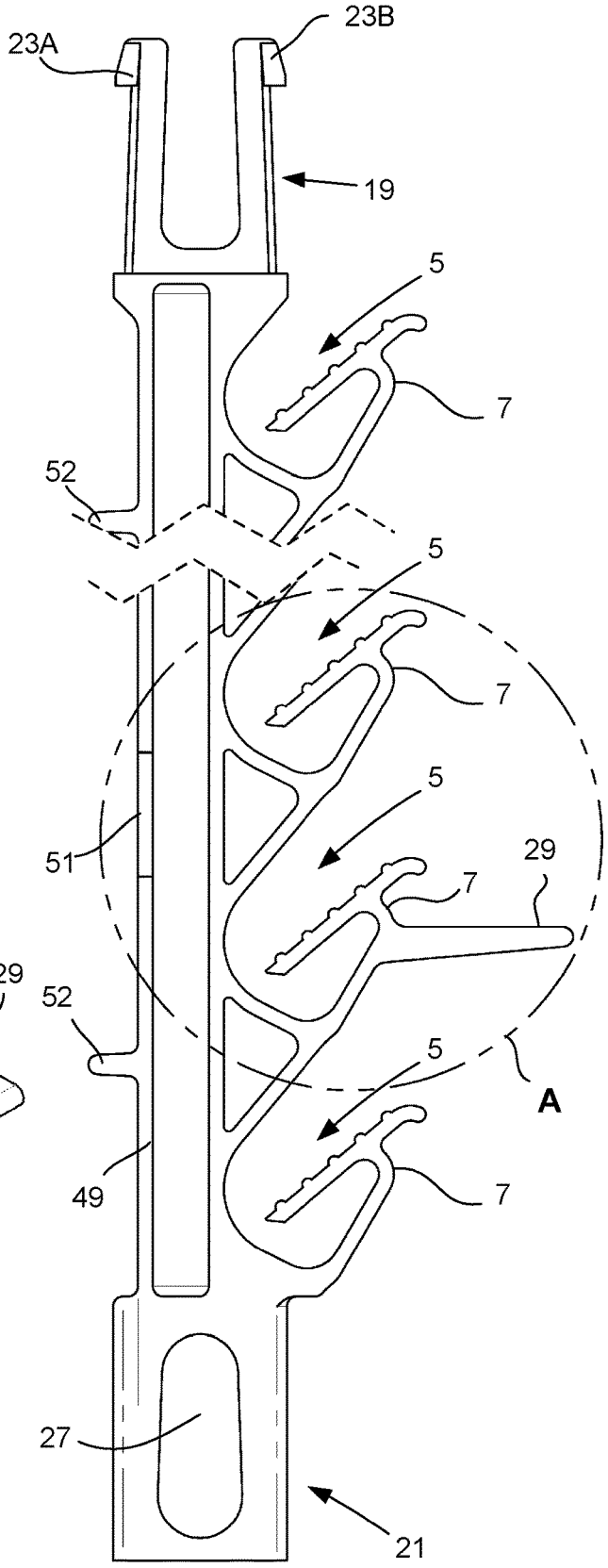
FIG. 3 is a side plan view of the rebar support of FIG. 1 with a break along its length.
Figure 3A:
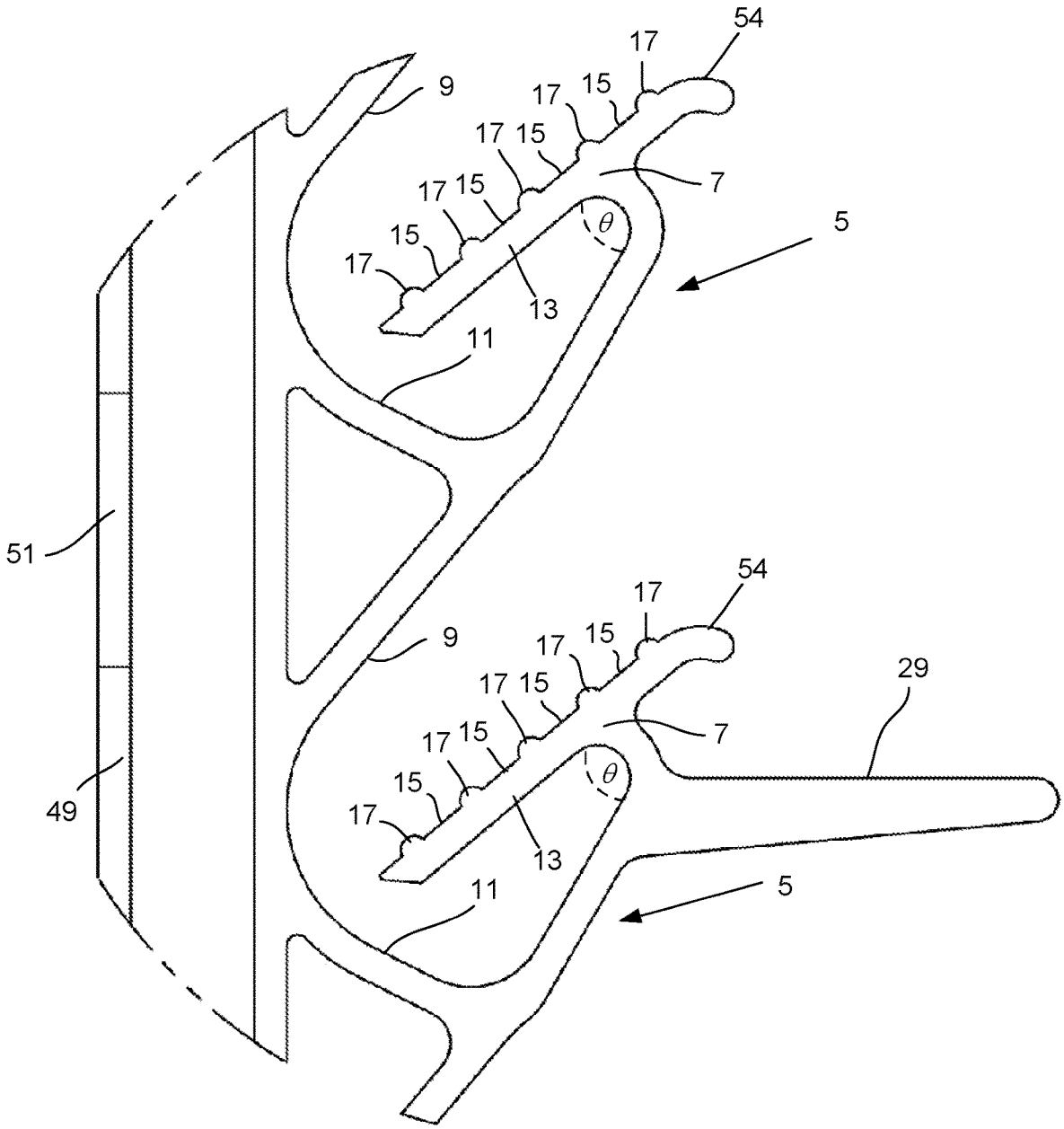
FIG. 3A is a close up of a detail "A" of FIG. 3.

With reference to FIGS. 2, 3 and 3A, each of the rebar cradles 5 includes a retaining member 7 for biasing rebar against an upwardly and outwardly angled wall 9 of the cradle 5 to thereby hold the rebar firmly within the cradle.

As may be most clearly seen in FIG. 3A, in the preferred embodiment of the invention the retaining member 7 extends from a downwardly angled side 11 of the cradle 5 and is formed with a return 13 back toward the cradle 5 wherein an outer side 15 of the return 13 is disposed opposite the second upwardly and outwardly angled side 9 of the cradle 5. An entry lip 54 is provided that is continuous with the return 13 and which extends outwardly. The lip 54 provides two protrusions 17 in addition to those of the return to assist in guiding and retaining the rebar in the cradle.

The outer side 15 of the return 13 may be formed with gripping formations such as ribs 17 or other protrusions.

Figure 4:
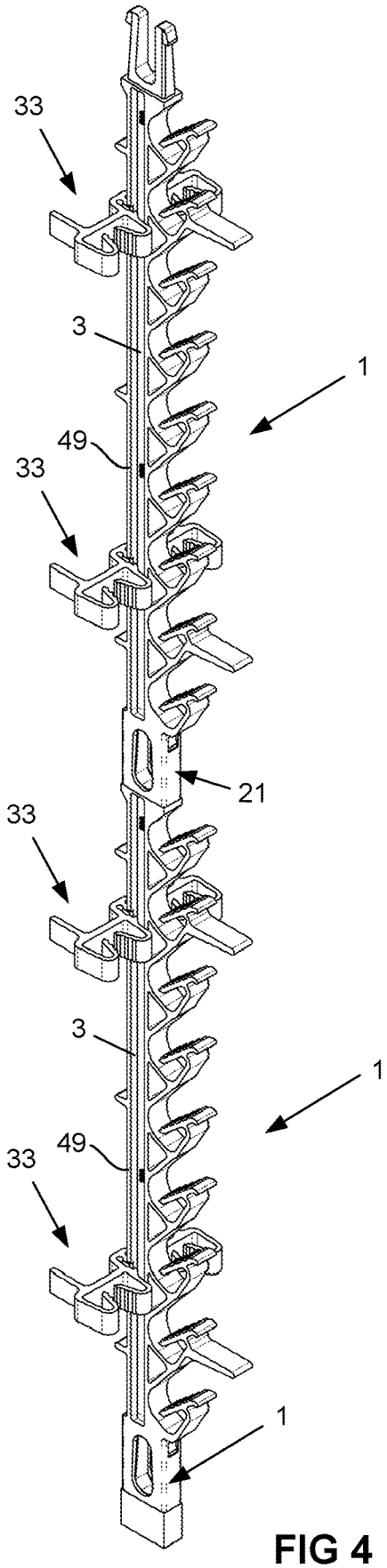
FIG. 4 is a view of two of the rebar supports of FIG. 1 joined end-to-end to form a rebar support assembly.

As may be seen in FIG. 4 the outsides of the retaining member 7 of some of the cradles are formed with spacing members 29 that extend laterally away from the elongate body 3 for spacing the rebar support 1 from adjacent formwork during use.

It will be observed that opposed ends of the elongate body 3 are formed with top and bottom complementary fasteners 19 and 21 so that a plurality of the rebar supports 1 may be fastened end-to-end.

More particularly the top fastener 19 is provided in the form of a plug whereas the bottom fastener 21 is provided in the form of an open ended socket for receiving the plug of another rebar support 1. The plug 19 includes first and second clasp members 23A, 23B which are received within the socket 21, which is formed with first and second openings 25A, 25B for engagement with the first and second clasp members 23A, 23B. It will therefore be understood that since the top fastener is a plug and the bottom fastener comprises a socket it is only possible to connect a number of the supports 1 together all having the same orientation, as shown in FIG. 4, which is advantageous.

It may be noted that the socket 21 has openings 27 formed through its walls in order that air cannot be trapped within, subsequent to concrete being poured about the rebar support 1.

Figure 6:
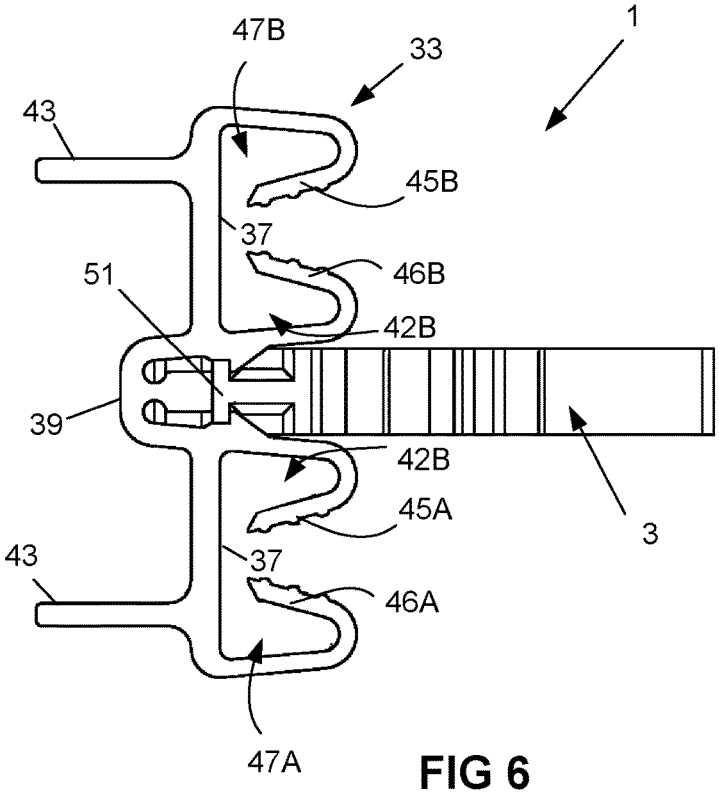
FIG. 6 is a top plan view of the rebar support.
Figure 5:
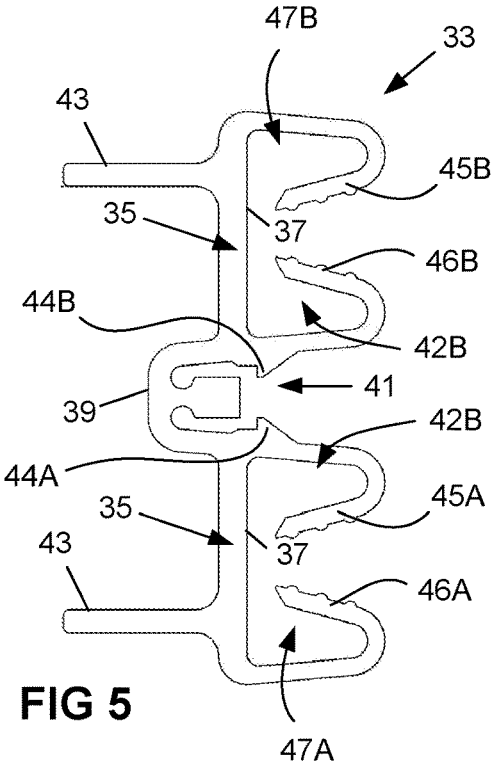
FIG. 5 is a top plan view of a chair of the rebar support according to the preferred embodiment of the invention.

With reference to FIGS. 5 and 6, in the presently described preferred embodiment of the invention the rebar support 1 further includes a second set of cradles 47A, 47B for retaining a steel reinforcement member, such as a longitudinal steel reinforcement for a poured concrete wall, at right angles to the first plurality of cradles 5.

The one or more second cradles 47A, 47B are provided by each of a number of chairs 33 that extend from the back of the elongate body 3, as can be seen in FIG. 4. As will be seen, the chairs comprise members that are transverse to the elongate body and which each provide one or more cradles for one or more pieces of rebar to be fastened parallel to the elongate body.

Each chair 33 is provided as a separate part that fastens to the elongate body 3. As best seen in FIG. 5 the chair 33 includes a crossmember 35 having first and second sides 37, 39 wherein an engagement formation 41 for attachment to the elongate body 3 is located medially and is accessible from the first side 37 and wherein one or more spacers in the form of standoff tabs 43 extend from the second side 39. The standoff tabs 43 distance the chair and thus the longitudinal steel bars from the face of the concrete subsequent to the pour and allow the concrete to fill in behind the chair.

Figure 7A:
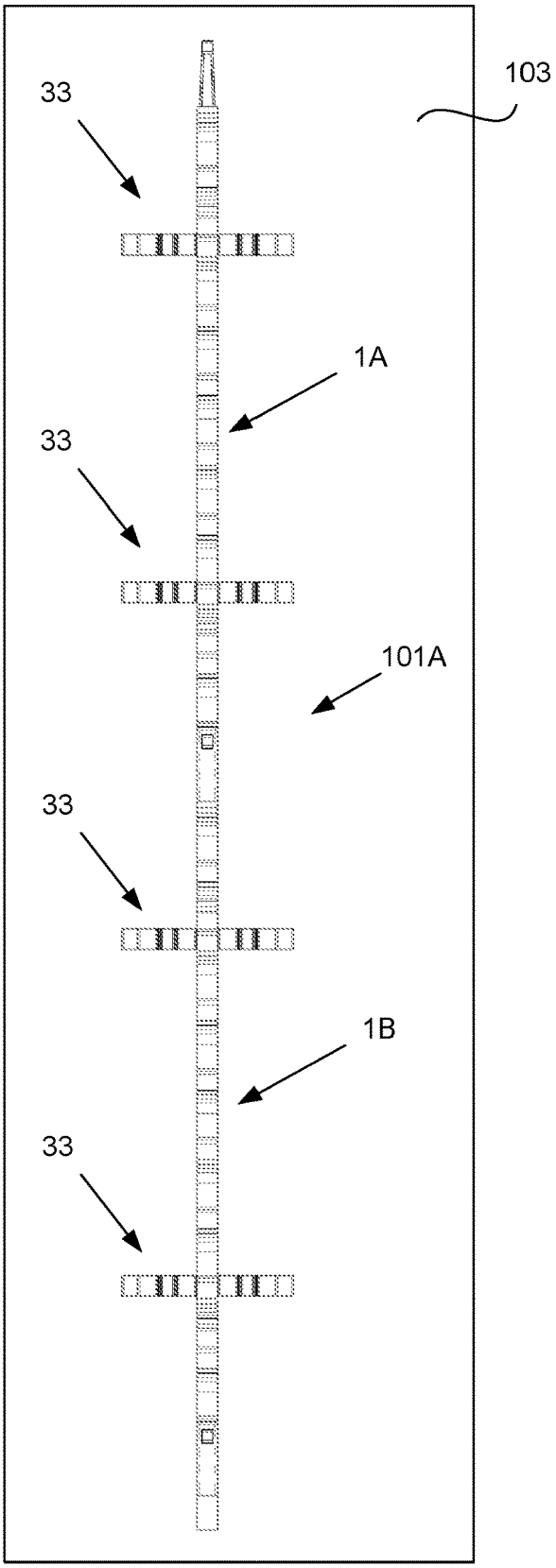
FIG. 7A shows a rebar assembly laid on a flat horizontal surface in preparation for insertion of longitudinal steel rebar into the chair cradles.
Figure 7B:
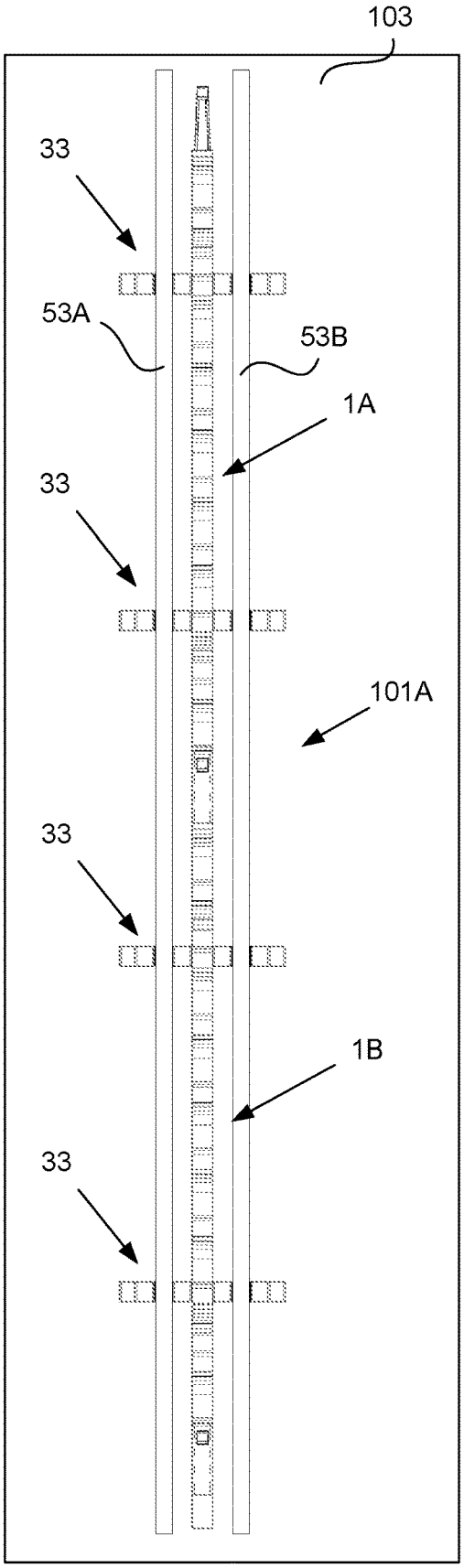
FIG. 7B shows the rebar assembly with longitudinal steel rebar fitted into the chair cradles.
Figure 7C:
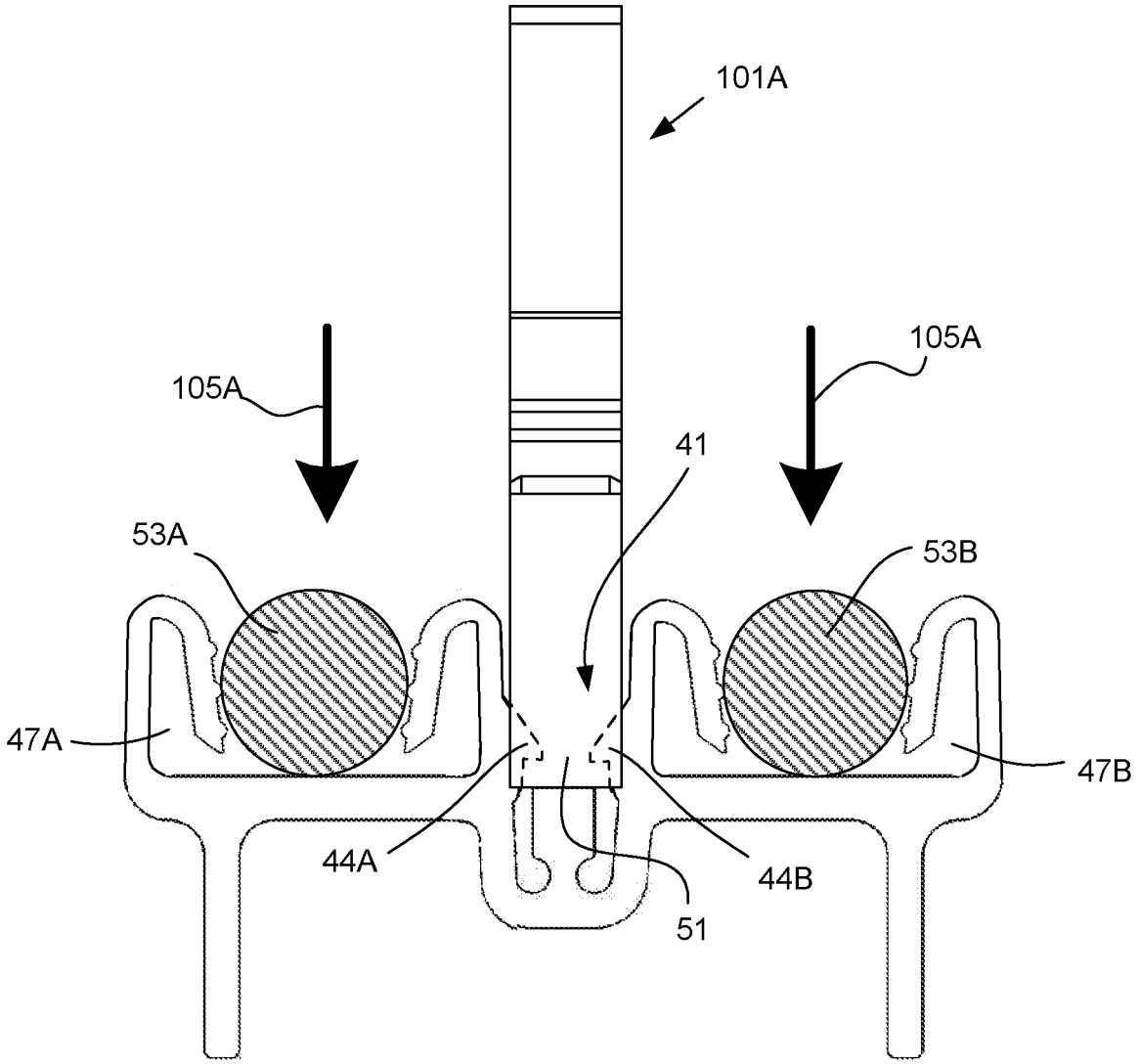
FIG. 7C is a diagram showing an end view of a rebar support with longitudinal steel reinforcement rebars installed in the first and second cradles of the chairs.

The chair cradles 47A, 47B extend from the first side of chair 33. Each of the cradles is formed with pairs of opposed retaining member 45A, 46A and 45B, 46B comprising angled returns that in use bias steel reinforcement against against each other. The chair clip 41 includes opposed resilient catch members 44A, 44B that are urged toward each other upon insertion of steel reinforcement members into the cradles 47A and 47B as illustrated in FIG. 7C.

As best seen in FIG. 2, the elongate body 3 is formed with a rail 49 or "backbone" for imparting rigidity along the length of the elongate body. Opposed cutouts 51 are formed into opposite sides of the rail for receiving the chair clip 41. FIG. 6 is a top plan view of the rebar support 1 showing the chair 33 attached to the elongate body 3. Stand-off tabs 52 extend from the rail 49 at spaced apart intervals to ensure that there is space between the rail and adjacent formwork for the flow of concrete.

A range of chairs 33 may be provided each having different sized cradles for accommodating longitudinal bar of different diameters. Chairs with different sized cradles may be alternately fixed along the rail 49. The cradle sizes accommodate for example for 16 mm, 25 mm, and 32 mm steel bar diameters. The chair's dual mounting clip configuration allows the steel bars to be staggered from the opposite side of the starter lapping bar. As shown in FIG. 7C the shape of the chair clip 41 has been designed so that longitudinal steel bar 53A, 53B has been inserted into the cradles 47A, 47B it will abut the catch members 44A, 44B of the clip and force them hard against the cut outs 51 of the rail 49 so that the clip 41, and thus chair 33, cannot be removed.

Use for the Invention

A typical use of the invention will now be described in the context of arranging steel reinforcement prior to pouring a concrete wall. Reference will initially be made to FIGS. 7A to 7C and 8.

Step 1: Clip two (or more) 500*mm* rebar supports 1A, 1B, together end-to-end to form a rebar support assembly 101A and clip the chairs 33 on to the cut outs 51 of the back rail 49 of the rebar supports 1*a*, 1*b* and lay transverse on a flat hard surface 103 as shown in FIG. 7A Step 2: Press the longitudinal bar 53A, 53B into the chair cradles 47A, 47B of the chairs 33 as indicated by arrows 105A, 105B in FIG. 7C, thereby stiffening the elongate bodies 3 of each of the rebar supports 1A and 1B as shown in FIG. 7B. Pushing the longitudinal bars into the chair cradles 47A, 47B forces the catches 44A, 44B of the chair clips 41 of chairs 33 to bite hard into the rails cut outs 51 of rail 49 of each rebar support 1A, 1B of the rebar assembly 101A, as shown in FIG. 7C thereby ensuring that the chair clips 41 firmly grip the rail 49.

Step 3: lower the rebar support assembly 101A with attached longitudinal steel bars 53A, 53B down into the area where the wall is to be poured.

Figure 8:
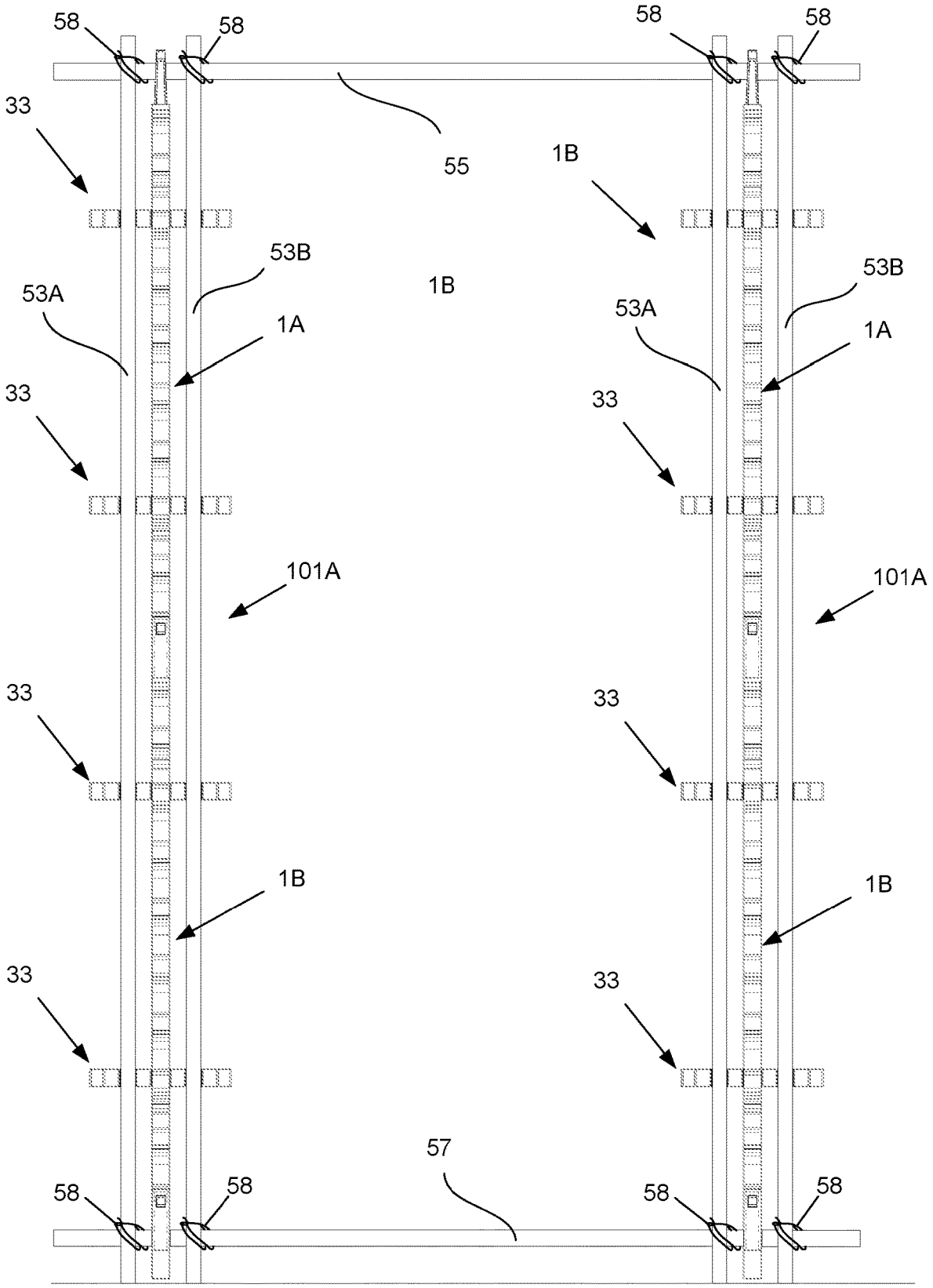
FIG. 8 shows two end-to-end rebar assemblies tied off at top and bottom to transverse steel members.

Step 4: repeat steps 1 to 3 in order to place a second rebar support assembly 101B comprising a second pair of end-to-end rebar supports 1A, 1B with longitudinal steel bars 53A, 53B about 2.5 m to the side of the first pair (as shown in FIG. 8) and continue along the length of the vertical wall area.

Step 5: Fix the rebar support assemblies 1A, 1B to a top bar 55 and bottom/lap bar 57 before installing any transverse rebars. Once rebar support assemblies 101A, 101B, have been put into place and tied off, with ties 58, at the top of the steel bar and attached to the existing lap bar 57, they form a template for arranging the transverse rebar has been set.

Figure 9:
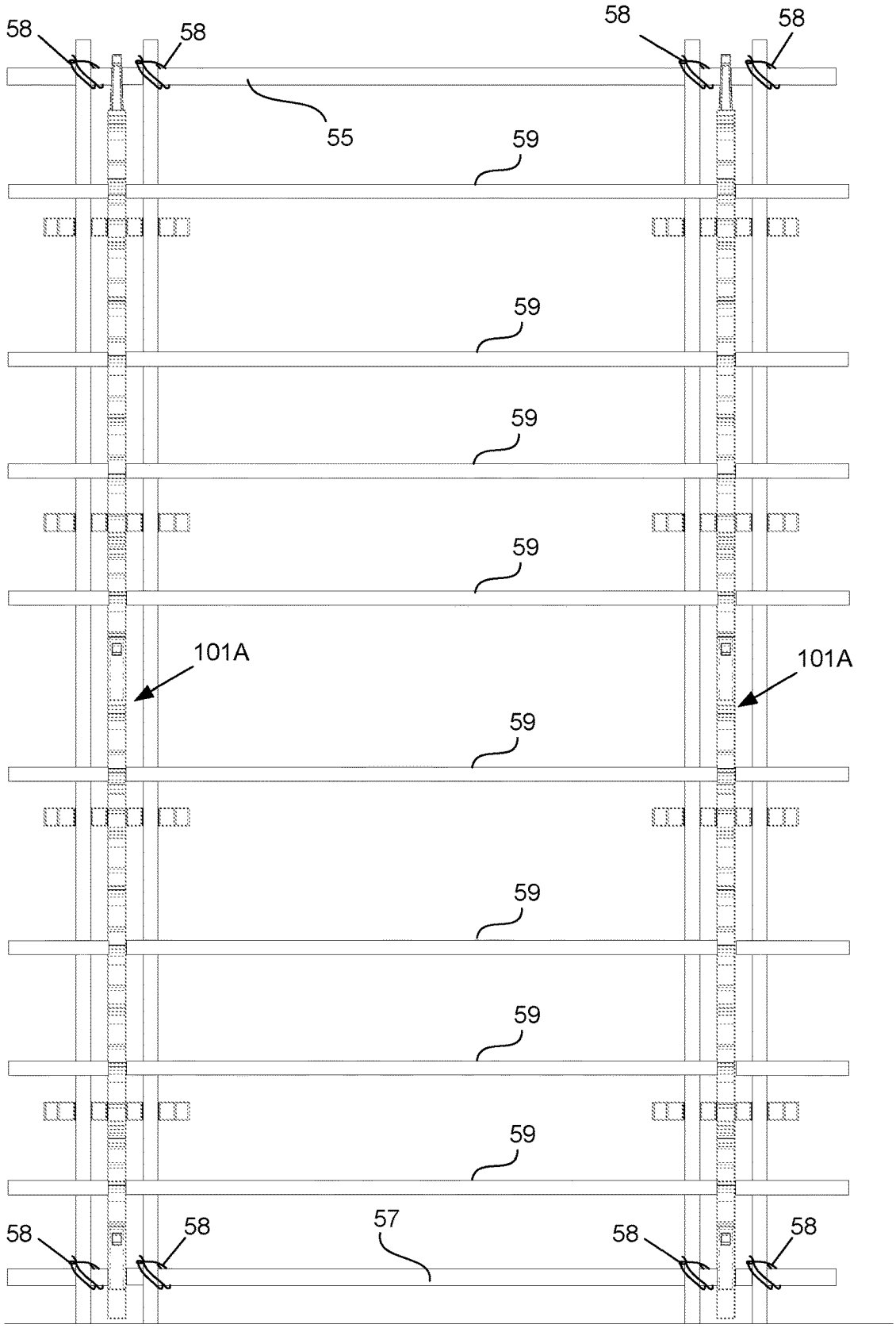
FIG. 9 shows the two end-to-end rebar assemblies of FIG. 8 with transverse rebar fitted in the cradles of the rebar supports.

Step 6: Feed all the transverse bars 59 into desired rebar cradles 5 all the way up the wall as shown in FIG. 9.

After the above described process has been completed on the back matt of steel repeat it on the front matt of steel.

Figure 10:
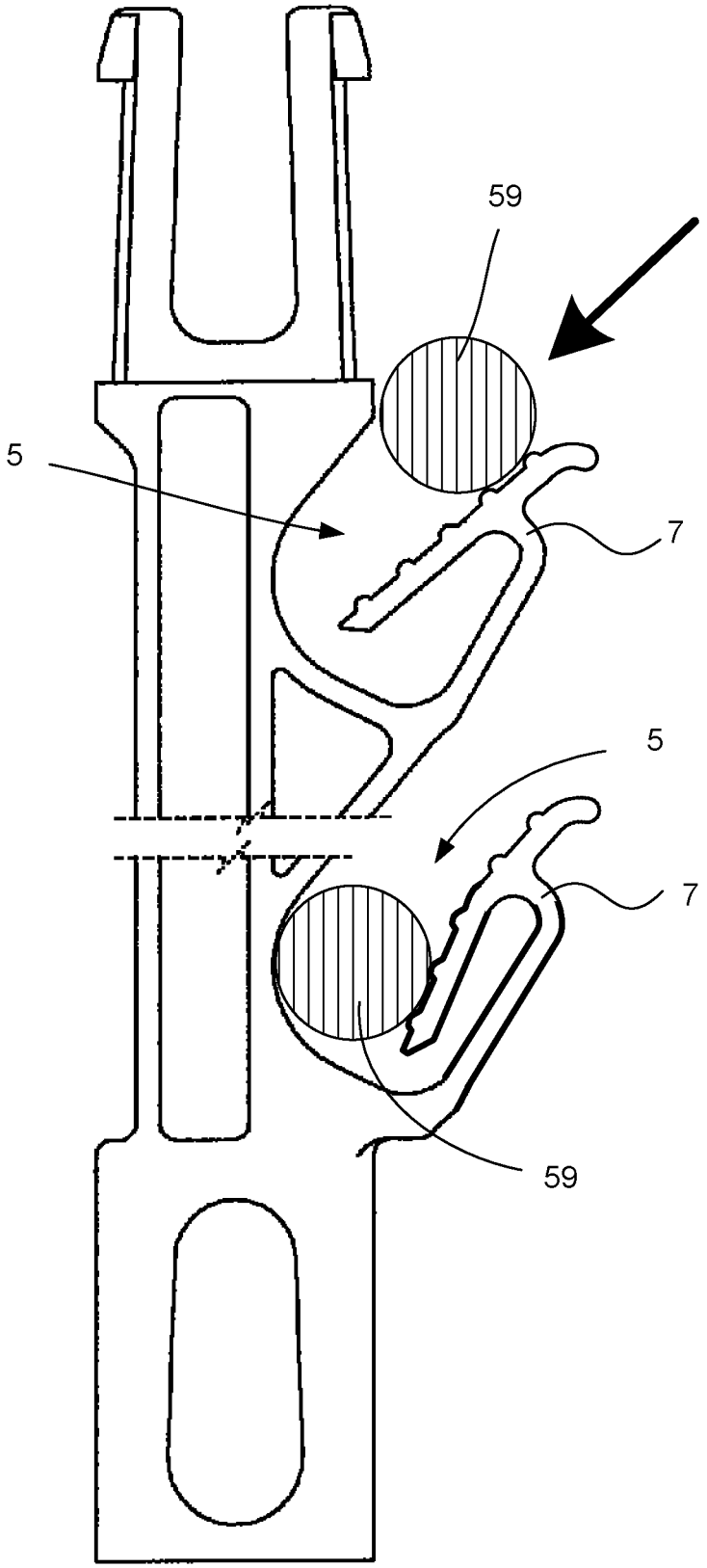
FIG. 10 shows the placement of transverse rebar into the cradles.

As a transverse rebar 59 is pushed into a cradle 5 it is fixed in place by the retaining member 7 as shown in FIG. 10.

Figure 11:
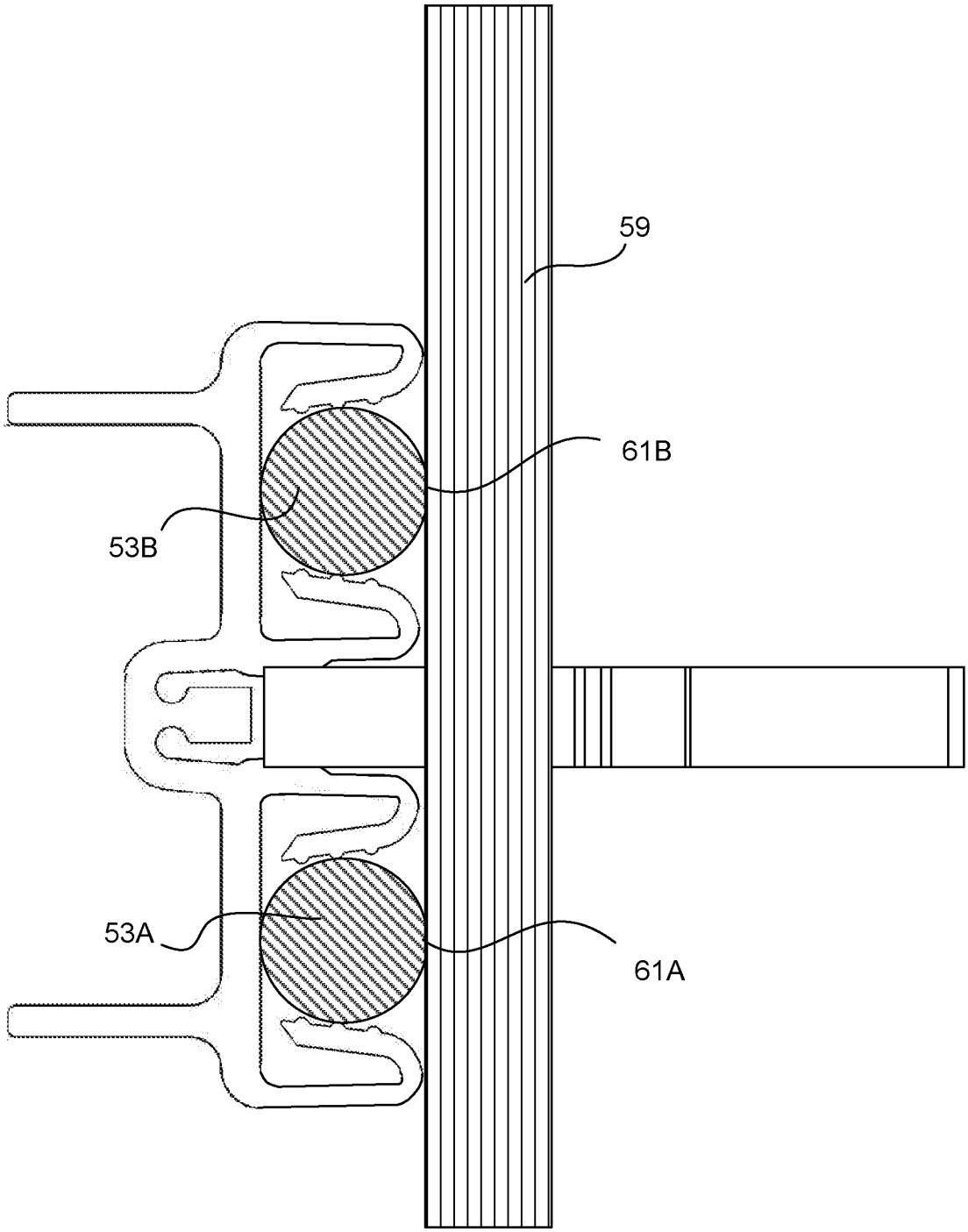
FIG. 11 is a top plan view of one of the rebar supports of FIG. 9.

With reference to FIG. 11, different diameters of the longitudinal bar 53*a*, 53*b* will make the transverse rebars 59 sit in different locations in the cradles 5 but will preferably maintain metal-to-metal contact at crossovers 61*a*, 61*b* of the longitudinal bars 53*a*, 53*b* and the transverse rebars 59.

Subsequent to the longitudinal steel bars 53A, 53B and the transverse steel rebars being arranged as described above the concrete is poured, thereby submerging the longitudinal steel, the transverse rebars and the rebar support assemblies. The concrete is then allowed to set about the reinforcement and the rebar supports to form a final concrete structure, such as a wall.

It will be observed that the above-described method can be performed without needing a steel fixer to hold or tie wire the transverse rebars 59 in place during the installation process. Consequently fewer workers are required and the time taken to install the transverse rebar 59 is greatly reduced.

It will be realized that the use of the rebar support has been primarily described in the context of arranging steel reinforcement members or "rebar" for the purpose of building a wall. However, it will be understood that the rebar support may be laid flat, for example for the pouring of a slab or deck. In that case all of the steel members will be horizontal but nevertheless there will be a first set of longitudinal reinforcement members that run along the chair cradles and a second set of transverse reinforcement members, at right angles that run across the cradles of the elongate body. The use of the rebar support member is therefore not limited to any particular orientation or the building of any specific type of concrete structure. Rather the rebar support provides a convenient way for arranging steel reinforcement members irrespective of the type of structure that is to be built.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention.

Therefore, it should be appreciated that various other changes and modifications can be made to any embodiment described without departing from the scope of the invention as defined by the appended claims.

What is claimed is:

1. A rebar support comprising an elongate body for use in a vertical orientation including:

a first plurality of rebar cradles disposed along its length for holding transverse rebars, each rebar cradle including at least one retaining member having an upwardly and outwardly angled wall for biasing against the transverse rebar to thereby hold said rebar within the cradle;

spacing members directly extending from the outwardly angled walls of a number of the retaining members for spacing from adjacent formwork in use; and a plurality of chairs locatable along the elongate body and each including a pair of second cradles for positioning on opposite sides of the elongate member, each of the pair of second cradles including retaining members to retain a corresponding longitudinal steel reinforcement member at right angles to the transverse rebars.

2. A rebar support according to claim 1, wherein each of the pair of second cradles of each of the chairs includes first and second opposed retaining members which cooperate for retaining a rebar therebetween within each second cradle.

3. A rebar support according to claim 1, wherein the each of the pair of second cradles is located equidistantly on opposite sides of the elongate member.

4. A rebar support according to claim 1, wherein each retaining member extends from a first side of each of the first plurality of cradles and is formed with a return back toward said cradle.

5. A rebar support according to claim 4, wherein the outer side of the return is formed with gripping formations for gripping the rebar.

6. A rebar support according to claim 5, wherein each retaining member is formed with a lip portion for assisting in guiding the rebar into the cradle.

7. A rebar support according to claim 1, wherein opposed ends of the elongate body are formed with complementary fasteners for fastening a plurality of the rebar supports end-to-end.

8. A rebar support according to claim 7, wherein a first end of the elongate body is formed with a complementary fastener in the form of a plug and wherein a second end of the elongate body is formed with a complementary fastener in the form of a socket.

9. A rebar support according to claim 8, wherein the plug includes first and second clasp members receivable within the socket wherein the socket is formed with first and second recesses or openings for engagement with the first and second clasp members for interconnecting the first and second ends of a number of rebar supports together whereby said supports all have the same orientation.

10. A rebar support according to claim 9, wherein the first and second clasp members are each elongate and each terminate with laterally extending protrusions for engagement within the first and second recesses or openings.

11. A rebar support according to claim 1, wherein the elongate body is formed with a rail for imparting rigidity along the length of the elongate body.

12. A rebar support according to claim 1, wherein each chair is detachable from the elongate body.

13. A rebar support according to claim 1, wherein each chair includes one or more spacers in the form of offset tabs extending away from the elongate body.

14. A rebar support according to claim 11, wherein each chair includes an engagement formation for attachment to the elongate body.

15. A rebar support according to claim 14 wherein the engagement formation comprises a chair clip.

16. A rebar support according to claim 15, wherein the chair clip includes opposed resilient catch members arranged for movement toward each other upon insertion of steel reinforcement members into the second cradles.

17. A rebar support according to claim 16, wherein opposed cutouts are formed into opposed sides of the rail for receiving the chair clip.

18. A rebar support according to claim 17, wherein the resilient catch members of the chair clip are arranged to move toward the opposed sides of the rail upon insertion of the steel reinforcement members into the second cradles.

19. A rebar support according to claim 1, wherein the rebar support is formed of non-ferrous material polyphenylene sulphide (PPS) that is unreactive with concrete.

20. A method for making a vertical steel reinforced concrete structure including the steps of:

installing vertically at least two, spaced apart, rebar support assemblies each support assembly comprised of two or more elongate rebar supports connected end to end, each rebar support having an elongate body, a series of vertically spaced cradles therealong for locating transverse rebars, each cradle including at least one retaining member having an upwardly and outwardly angled wall for biasing against the transverse rebar to thereby hold said transverse rebar within the cradle, and a plurality of chairs located along the elongate body and each including a pair of second cradles for positioning on opposite sides of the elongate member, each of the pair of second cradles including retaining members to retain a corresponding longitudinal steel reinforcement member at right angles to the transverse rebars, said supports being of a material that is unreactive to concrete, in a location for receiving a concrete pour;

disposing a first set of longitudinal rebars along each of the spaced apart rebar support members and a second set of transverse rebars between the spaced apart rebar members to thereby produce cross overs of rebars of the first set and of the second set;

making the concrete pour to submerge said rebar support members and said rebars wherein the rebar supports are spaced from adjacent formwork by spacing members directly extending from the outwardly angled walls of a number of retaining members of the vertically spaced cradles; and allowing the concrete to set about the rebar support members and the rebars.

* * * * *